US012704256B2

(12) United States Patent
Schmidt

(10) Patent No.: US 12,704,256 B2
(45) Date of Patent: Aug. 11, 2026

(54) PLUMBING VENT PLUG

(71) Applicant: Martin Henry Schmidt, Kippen (CA)

(72) Inventor: Martin Henry Schmidt, Kippen (CA)

( * ) Notice: Subject to any disclaimer, the term of this patent is extended or adjusted under 35 U.S.C. 154(b) by 396 days.

(21) Appl. No.: 18/413,141

(22) Filed: Jan. 16, 2024

(65) Prior Publication Data

US 2025/0230928 A1 Jul. 17, 2025

(51) Int. Cl.
*F23L 17/12* (2006.01)
*E03C 1/122* (2006.01)

(52) U.S. Cl.
CPC ..... *F23L 17/12* (2013.01)

(58) Field of Classification Search
CPC ..... F23L 17/12; E03C 1/1225; G01M 3/022; F16L 55/115; F16L 55/1157
See application file for complete search history.

(56) References Cited

U.S. PATENT DOCUMENTS 3,334,662 A * 8/1967 Wesolowski ..... F16L 55/1286 138/89
4,936,351 A * 6/1990 Wells ..... F16L 55/115 138/104
5,074,336 A * 12/1991 Black ..... F16L 55/115 138/89
5,520,219 A * 5/1996 Hessian ..... G01M 3/022 138/90

* cited by examiner

*Primary Examiner* — Steven S Anderson, II
(74) *Attorney, Agent, or Firm* — Orin Del Vecchio

(57) ABSTRACT

A roof vent capping device that is configured to sealably secured to an opening of a roof vent pipe so as to facilitate a pressure test of a plumbing network. The present invention is configured to be removed from the roof vent pipe from a distal location ensuing the pressure test. The roof vent capping device includes a cap member wherein the cap member has an upper portion and a lower portion. The lower portion has a diameter configured to be inserted into the opening of a roof vent pipe and provide a hermetic seal. A securing member is superposed over the cap member and includes end members that are configured to releasably secure to the roof vent pipe. A pull member is operably coupled to the securing member and the cap member and includes a second end distally located from the roof vent pipe.

8 Claims, 3 Drawing Sheets

PLUMBING VENT PLUG

FIELD OF THE INVENTION

The present invention relates generally to plumbing, more specifically but no by way of limitation, a roof vent plumbing plug that is configured to be releasably secured to a roof vent pipe wherein the present invention is constructed to be removed from a ground position as opposed to climbing on the roof to remove subsequent a pressure test of the plumbing system of the structure.

BACKGROUND

Plumbing system in structures such as but not limited to residential structures consist of a network of pipes that are operable to provides fresh water to various fixtures in the structure as well as facilitate the removal of waste water. All plumbing pipe networks include vent pipes wherein the vent pipes typically penetrate the roof of the structure. The plumbing vent pipes supply fresh air to each plumbing fixture in the structure which helps the plumbing system move water through the drainage pipes each time a toilet is flushed or a sink is drained. The plumbing vent helps regulate the air pressure in the plumbing system.

During construction of a structure there are numerous inspections that must occur for various components of the structure. Systems such as but not limited to electrical and plumbing are subjected to numerous inspections during the construction process. For the plumbing system, there is typically a pressure test of the plumbing network prior to the installation of wall surfaces. During this test, the roof vents are capped so as to seal the plumbing network to perform a pressure test so as to ensure no leaks are present in any of the operable connections between the pipes that comprise the plumbing network. Ensuing the successful completion of the pressure test, the plumbing vents must have the caps removed therefrom. This often requires that plumbers climb back onto the roof to remove the cap from the plumbing vent pipe. Many times there is not the proper safety equipment for the plumber and the climbing onto the roof can be quite dangerous.

Accordingly, there is a need for a plumbing vent cap that is configured to be releasably secured to a roof vent pipe wherein the plumbing vent cap of the present invention can be removed from a location distal to the roof vent pipe such as but not limited to the ground.

SUMMARY OF THE INVENTION

It is the object of the present invention to provide a roof vent pipe cap configured to be releasably secured to a roof vent pipe wherein the present invention includes a cap member having body being manufactured from plastic or other suitable material.

Another object of the present invention is to provide a cap configured to be secured to a roof vent pipe during a pressure test of a plumbing network and subsequently removed wherein the cap member of the present invention includes an upper portion and a lower portion.

A further object of the present invention is to provide a roof vent pipe cap configured to be releasably secured to a roof vent pipe wherein the lower portion has a diameter configured to be inserted into an opening of the roof vent pipe.

Yet a further object of the present invention is to provide a cap configured to be secured to a roof vent pipe during a pressure test of a plumbing network and subsequently removed wherein the upper portion is dome shaped and includes a lower perimeter edge that has a diameter greater than that of the lower portion of the body.

Still another object of the present invention is to provide a roof vent pipe cap configured to be releasably secured to a roof vent pipe wherein the present invention further includes a securing member wherein the securing member is arcuate in shape having a first end and a second end.

An additional object of the present invention is to provide a cap configured to be secured to a roof vent pipe during a pressure test of a plumbing network and subsequently removed wherein the first end and second end of the securing member are configured to releasably secure to the end of the roof vent pipe.

Yet a further object of the present invention is to provide a roof vent pipe cap configured to be releasably secured to a roof vent pipe wherein the securing member has operably coupled thereto a pull member wherein the pull member includes a first end secured to the securing member and a second end distally located therefrom.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
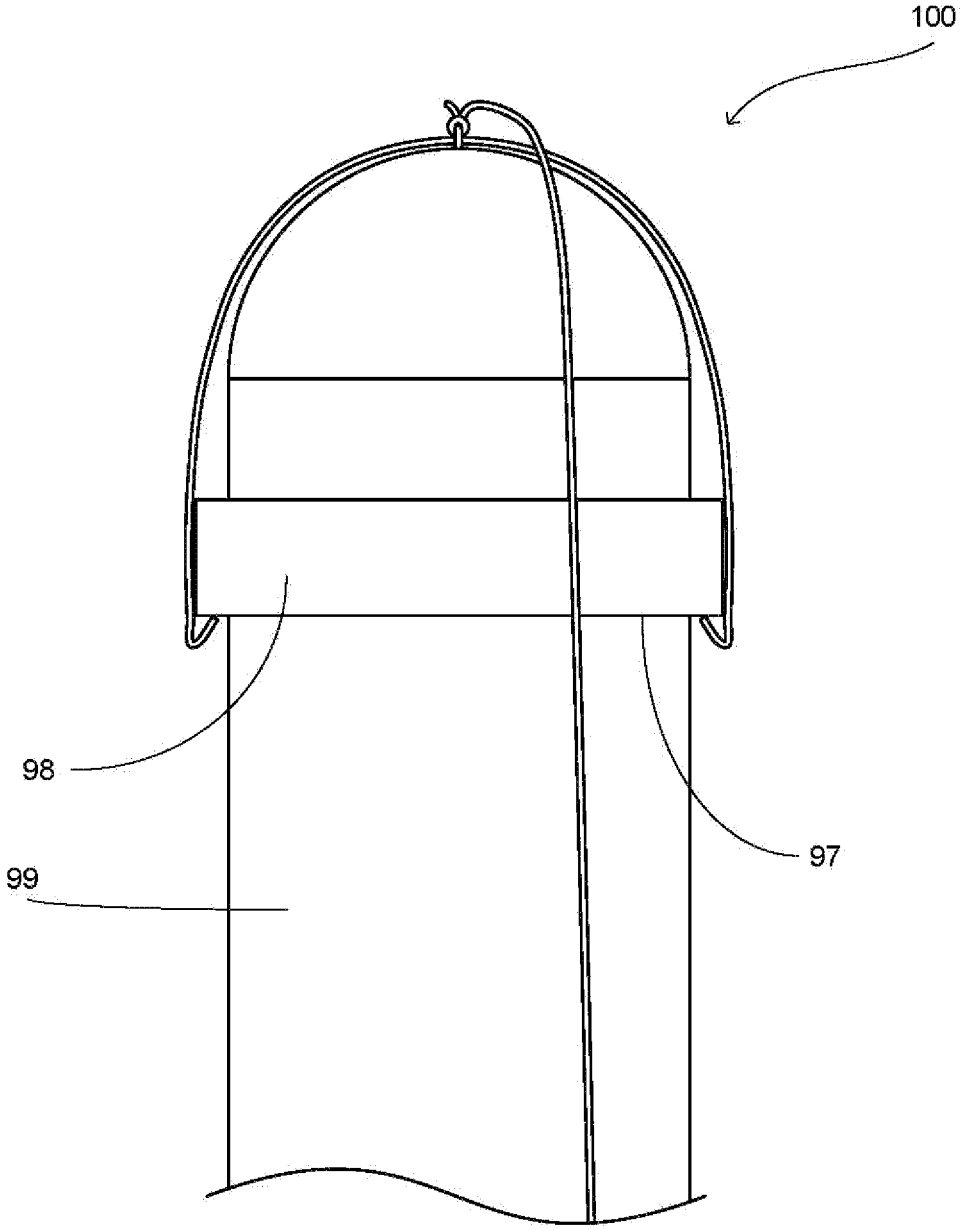
FIG. 1 is a side view of the present invention operably coupled to an exemplary roof vent pipe.
Figure 2:
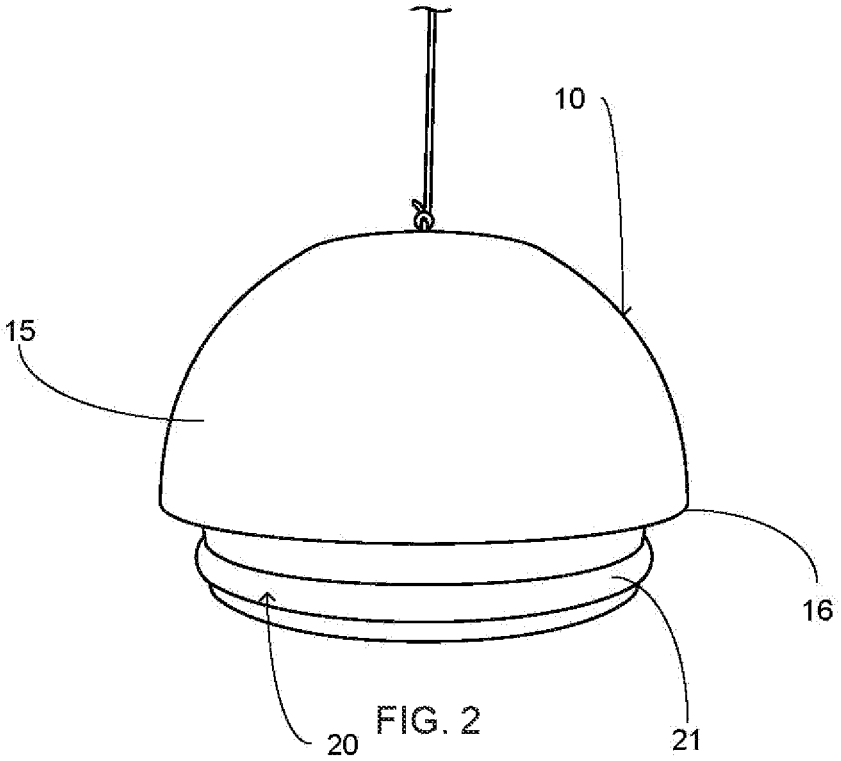
FIG. 2 is a side view of the cap member of the present invention.
Figure 3:
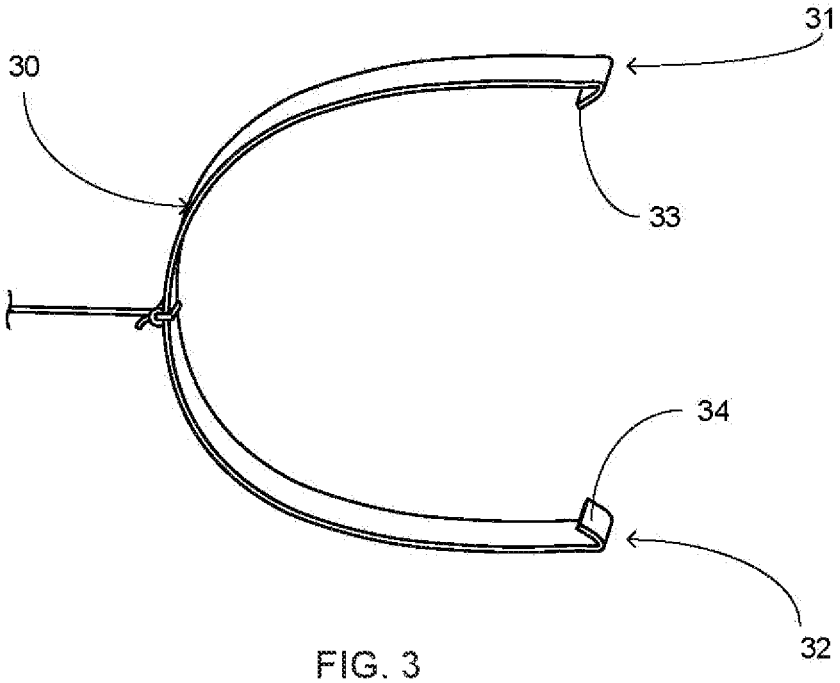
FIG. 3 is a side view of the securing member of the present invention.
Figure 4:
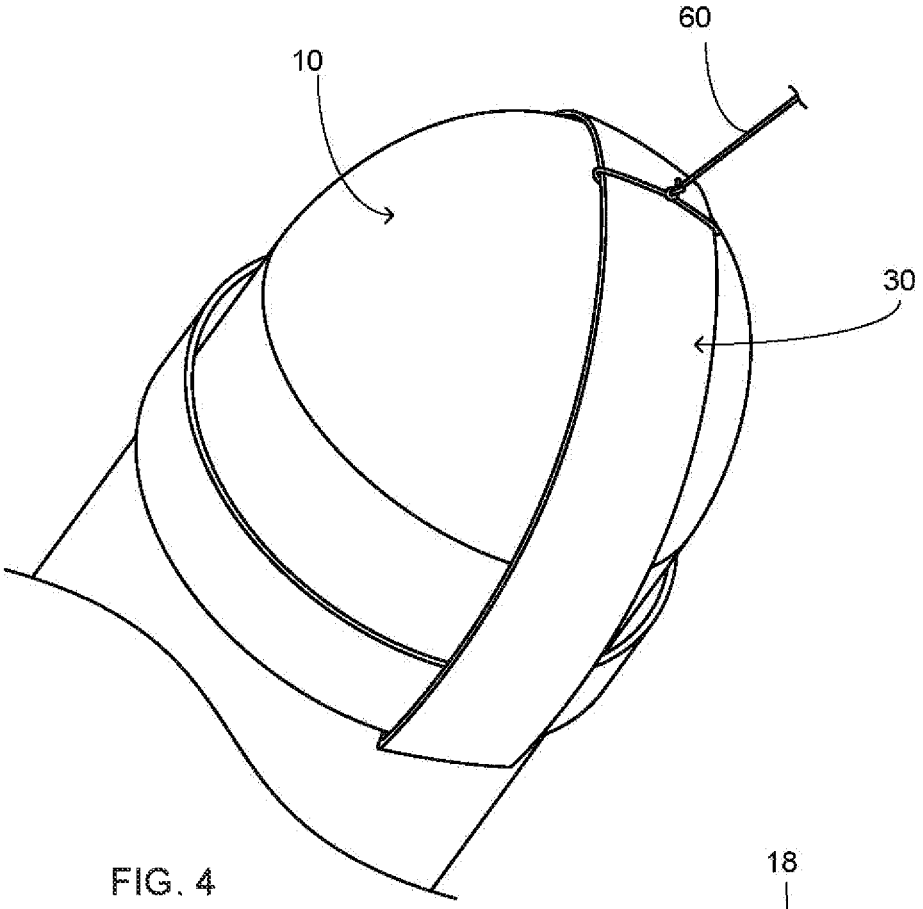
FIG. 4 is a top perspective view of the present invention operably coupled to an exemplary roof vent pipe.
Figure 5:
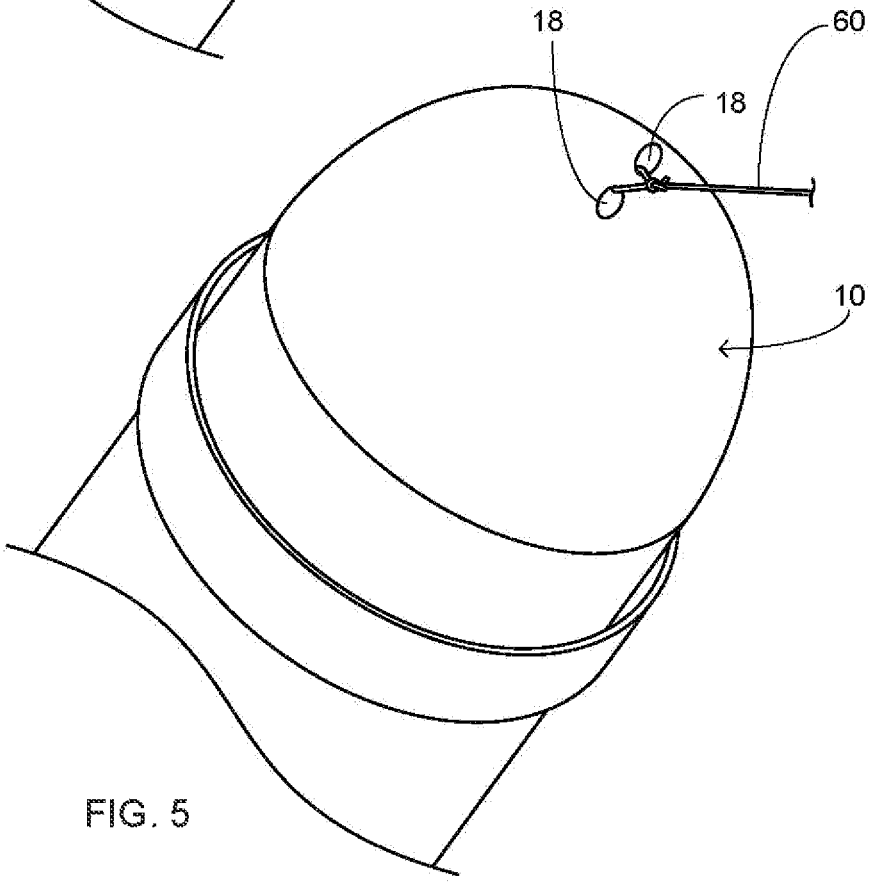
FIG. 5 is a top perspective view of the cap member of the present invention.

Referring now to the drawings submitted herewith, wherein various elements depicted therein are not necessarily drawn to scale and wherein through the views and figures like elements are referenced with identical reference numerals, there is illustrated a roof vent capping device 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the roof vent capping device 100 includes a cap member 10. The cap member 10 is manufactured from a suitable durable material such as but not limited to plastic. The cap member 10 includes an upper portion 15 and a lower portion 20 being contiguously formed. The upper portion 15 is dome shaped having a lower perimeter edge 16. The lower perimeter edge 16 has a diameter that is generally equal to that of the exemplary roof vent pipe 99 so as to facilitate the cap member 10 being superposed on top of the opening of the roof vent pipe 99. While the upper portion is dome shaped, it is contemplated within the scope of the present invention that the upper portion 15 of the cap member 10 could be provided in alternate shapes. The upper portion 15 further includes apertures 18 formed at the top of the upper portion 15. The apertures 18 are provided so as to operable coupled with an end of the pull member 60 as is further discussed herein. The apertures 18 are adjacent each other so as to provide a configuration for engaging the end of the pull member 60. It is contemplated within the scope of the present invention that alternate quantities of apertures could be employed to accomplish fastening an end of the pull member 60 to the upper portion 15 of the cap member 10. It should be understood within the scope of the present invention that the upper portion 15 could employ alternate elements in place of and/or in conjunction with the apertures so as to operably engage with the pull member 60.

The lower portion 20 of the cap member 10 extends downward from the upper portion 15 and has a diameter that is configured to facilitate penetration into the opening of the roof vent pipe 99. The lower portion 20 is operable to be inserted into the opening of the roof vent pipe 99 so as to sealably secure the opening thereof in order to execute a pressure test on a plumbing network of which the roof vent pipe 99 is a part thereof. The lower portion 20 includes O-ring 21 that is operable to ensure a hermetic seal between the lower portion 20 of the cap member 10 and the roof vent pipe 99. It is contemplated within the scope of the present invention that alternate elements could be employed to provide a hermetic seal between the lower portion 20 and the roof vent pipe 99.

The roof vent capping device 100 further includes a securing member 30. The securing member 30 is manufactured from a suitable material such as but not limited to metal flat bar. The securing member 30 is arcuate in shape having a length sufficient to extend over the cap member 10 and engage with the outer ring 98 of the roof vent pipe 99. The securing member 30 includes a first end 31 and a second end 32. First end 31 includes a first tab member 33 and second end 32 includes a second tab member 34. First tab member 33 and second tab member 34 are formed inwards and upwards so as to facilitate releasably securing with the lower edge 97 of the outer ring 98 of the roof vent pipe 99. The securing member 30 ensures the maintenance of position of the cap member 10 during a pressure test of a plumbing network of which the roof vent pipe 99 is a part thereof. While the securing member 30 is illustrated herein in a preferred embodiment, it is contemplated within the scope of the present invention that the securing member 30 could be provided in alternate embodiments and achieve the desired objective discussed herein.

The roof vent capping device 100 further includes a pull member 60. The pull member 60 is configured to facilitate removal of the securing member 30 and cap member 10 ensuing execution of a pressure test. The pull member 60 in a preferred embodiment is an elongated piece of string or other suitable material having a first end thereof secured to both the securing member 30 and the cap member 10. The pull member 60 is provided in a sufficient length so as to be reachable by a user wherein the user can access without climbing onto a roof. The pull member 60 is of a length so as to place the second end proximate the ground adjacent the structure in order to be easily accessible for a user. The user tugs on the second end of the pull member 60 which results in the securing member 30 becoming dislodged and subsequently the cap member 10 being removed. It should be understood within the scope of the present invention that the pull member 60 could be arranged in various manners in order to facilitate the removal of the securing member 30 and then the cap member 10.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A roof vent capping device that is operable to hermetically seal an opening of a roof vent pipe wherein the roof vent capping device comprises:

a cap member, said cap member having an upper portion and a lower portion, said upper portion and said lower portion being contiguously formed, said lower portion having a diameter of sufficient size so as to be inserted into the opening of the roof vent pipe;

a securing member, said securing member having a first end and a second end, said securing member configured to be superposed said cap member, said first end and said second end being configured to releasably secure to the roof vent pipe; and a pull member, said pull member being elongated, said pull member having a first end and a second end, said first end of said pull member being operably coupled to said securing member and said cap member, said second end of said pull member being distally located from the roof vent pipe.

2. The roof vent capping device operable to hermetically seal an opening of a roof vent pipe as recited in claim 1, wherein said securing member is arcuate in form.

3. The roof vent capping device operable to hermetically seal an opening of a roof vent pipe as recited in claim 2, wherein said pull member is manufactured from string.

4. The roof vent capping device operable to hermetically seal an opening of a roof vent pipe as recited in claim 3, wherein said first end of said securing member includes a first tab member, said first tab member configured to engage the roof vent pipe.

5. The roof vent capping device operable to hermetically seal an opening of a roof vent pipe as recited in claim 4, wherein said upper portion of said cap member further includes an aperture, said aperture configured to operably couple with said first end of said pull member.

6. The roof vent capping device operable to hermetically seal an opening of a roof vent pipe as recited in claim 5, wherein said second end of said securing member includes a second tab member, said second tab member configured to engage the roof vent pipe diametrically opposite said first tab member.

7. A roof vent capping device that is operable to hermetically seal an opening of a roof vent pipe in order to perform a pressure test in a plumbing network wherein the roof vent capping device comprises:

a cap member, said cap member having an upper portion and a lower portion, said upper portion being dome shaped, said upper portion and said lower portion being contiguously formed, said lower portion extending downward from said upper portion, said lower portion having an O-ring secured to an outer surface thereof, said lower portion having a diameter of sufficient size so as to be inserted into the opening of the roof vent pipe;

a securing member, said securing member being arcuate in shape, said securing member having a first end and a second end, said securing member configured to be superposed said cap member, said first end having a first tab member formed thereon, said first tab member being oriented inwards and upwards, said second end of said securing member having a second tab member formed thereon, said second tab member being oriented inwards and upwards, said first tab member and said second tab member configured to releasably secure to said roof vent pipe; and a pull member, said pull member being elongated, said pull member having a first end and a second end, said first end of said pull member being operably coupled to said securing member and said cap member, said second end of said pull member being distally located from the roof vent pipe.

8. The roof vent capping device operable to hermetically seal an opening of a roof vent pipe as recited in claim 7, wherein said upper portion of said cap member further includes a pair of apertures, said pair of apertures being located at a top end of said upper portion, said pair of apertures being adjacent each other.

* * * * *